US005087143A

United States Patent [19]

Hertrampf

[11] Patent Number: 5,087,143

[45] Date of Patent: Feb. 11, 1992

[54] FILLING TOOTHBRUSH

[76] Inventor: Michael Hertrampf, Schafereiweg 7, 3007 Gehrden 1, Fed. Rep. of Germany

[21] Appl. No.: 551,895

[22] Filed: Jul. 12, 1990

[30] Foreign Application Priority Data

Jul. 12, 1989 [DE] Fed. Rep. of Germany ..... 3922850

[51] Int. Cl.[5] ..... A46B 11/02

[52] U.S. Cl. ..... 401/146; 401/141; 401/171; 401/176; 401/177; 401/270

[58] Field of Search ..... 401/141, 146, 171, 176, 401/177, 185, 270

[56] References Cited

U.S. PATENT DOCUMENTS 4,692,047 9/1987 Endo ..... 401/141
4,733,983 3/1988 Hertrampf ..... 401/171 X

FOREIGN PATENT DOCUMENTS 1008463 5/1952 France ..... 401/141

*Primary Examiner*—Steven A. Bratlie
*Attorney, Agent, or Firm*—Allegretti & Witcoff, Ltd.

[57] ABSTRACT

A filling toothbrush having a hollow handle providing a supply space for toothpaste. A toothpaste dischage aperture is provided on the outer end of the handle beneath the bristles. A conduit inside the handle connects the aperture to the supply space at the inner end of the handle where a pump forces toothpaste through the conduit. The supply space has a cross-section increasing toward the pump in two stages provided by a first cylinder and a second cylinder within the handle. A piston within said first cylinder moves downwardly to push toothpaste toward the pump at the inner end of the handle. The second cylinder has a piston in the form of a ring having a width sufficient to span the difference in diameters of the first and second cylinders. An inwardly projecting flange on the ring piston is engaged by the first piston as it moves toward the pump and the two pistons then move in unison to expel toothpaste from the second cylinder.

4 Claims, 1 Drawing Sheet

FILLING TOOTHBRUSH

The invention relates to a filling toothbrush having a hollow handle for storing toothpaste and means for discharging toothpaste through an aperture to the bristles on one end of the handle.

THE PRIOR ART

A filling toothbrush of this type is disclosed in DE-PS 36 03 475, in which the supply space is formed by a casing of variable volume having an aperture. A valve is disposed through the edge of the casing aperture. A space between the internal wall of the handle and the casing is vented to the outside environment. The casing collapses as the toothpaste is used to avoid the drying out of the toothpaste in the casing. One disadvantage of this construction consists of the fact that the stresses exerted on the casing, which may have the shape of a bellows, are relatively great. Moreover, this casing furthermore constitutes an additional element which increases the price of the toothbrush and, in addition, involves difficulties in sealing.

A filling toothbrush is disclosed in U.S. Pat No. 4,388,011 which has a hollow handle containing internal telescoping tube parts which form the supply space. This does, to be sure, prevent a drying out of the toothpaste, but its construction is complex and relatively expensive. Furthermore, it has the disadvantage that a residue always remains within the supply space after all tube elements have been telescopically inserted into one another. This leads to a loss of toothpaste. A projection directed towards the interior of the larger tube does not ensure the complete emptying of the supply space. Finally, one additional disadvantage consists of the fact that there is a large materials requirement for the individual tube elements which increases the price of the finished product.

THE INVENTION

The object of the invention is to provide a filling toothbrush of the type described in which a complicated bellows is not necessary in which the supply space can be completely emptied and which is simple and inexpensive in its construction. It is intended that the toothbrush be discarded after the toothpaste in the handle is used up.

The basic concept of the invention consists of utilizing the hollow handle itself as a cylinder and cooperating piston device. The cylinder space is divided into individual cylinder sections of successively smaller diameters. A small, short piston is positioned inside each cylinder section. As the toothpaste supply space empties, specifically because of negative pressure through a pumping device, the piston in the cylinder section with the smallest diameter moves first, because this piston extends over the entire cross-sectional area of its cylinder section and is consequently acted upon by atmospheric pressure resulting from internal negative pressure by the pumping device. A ring-shaped piston in the next larger cylinder is not, at the beginning, acted upon by atmospheric pressure. It does not move until the piston in the cylinder section of smallest diameter pushes against the ring-shaped piston in the following cylindrical section of greater diameter. The small diameter piston, together with the ring-shaped piston, forms a larger piston for expelling toothpaste from the larger cylindrical space.

Since the pistons increase very slightly in size in the direction of movement, only a very small amount of toothpaste, or even no toothpaste whatever, remains behind at the end of the emptying process. The advantage of a small materials requirement is attributable to the slight expansion of the individual pistons.

Several cylinder sections of gradually enlarged diameter are positioned one after another. This results in the provision of a conical or tapered form of the handle which is advantageous for handling.

The pistons preferably have cylindrical sealing lips in contact with the specific cylinder sections, which ensure not only a sealing, but also a guiding of the piston.

The base of the supply space, in the area of the pump, has a contour or profile which is essentially complementary to the contour of the pistons so that no space remains between these parts when the combined pistons reach the end of their stroke.

A tube or conduit connects the pumping device at the end of the handle opposite the bristle end to an aperture beneath the bristles. The tube extends through an aperture in the small diameter piston. By this means, the handle is simplified in an overall manner and the tube serves as a guide for the small diameter which slides on the tube.

THE DRAWING

The invention will now be illustrated in greater detail by means of the accompanying drawing showing a side view of the toothbrush of the invention.

DETAILED DESCRIPTION

Figure 1:
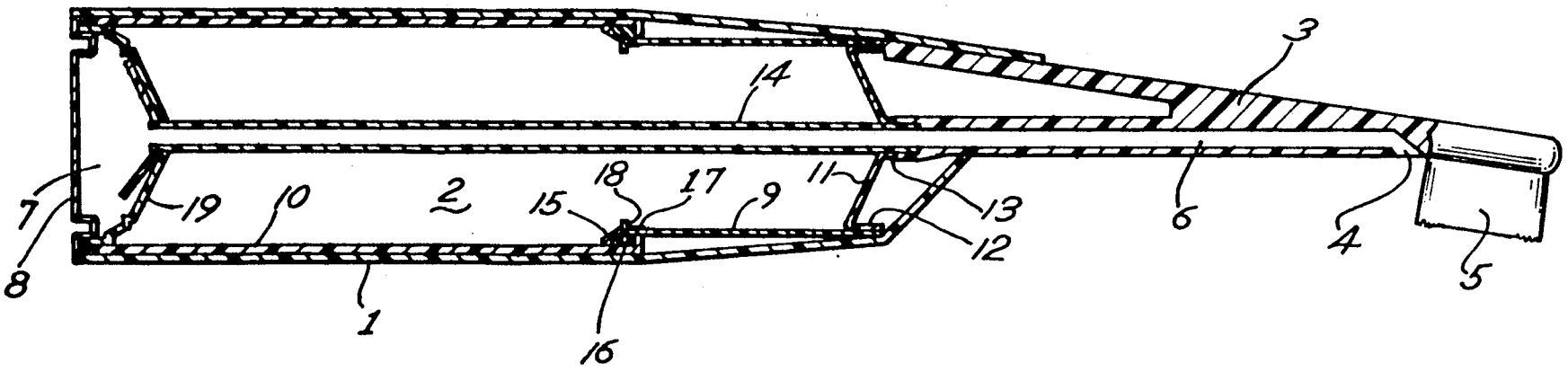

The filling toothbrush depicted in the drawing has a hollow handle 1, including a supply space 2 for toothpaste. At the outer end of the handle 1, there is positioned a support 3 in which there is positioned a discharge aperture 4 in the area of the bristles 5. The discharge aperture 4 is connected with the supply space 2 by way of a conduit 6 partially formed by the handle and a tube 14 which extends to pumping device 7 at the inner end of the handle 1. The pumping device, because it is not of significance for the understanding of the invention, is not depicted in detail. The pumping device has an activating element 8 in the form of a flexible membrane which can be depressed. Furthermore, a check valve, which is not depicted, is provided in the base 19 of the storage space 2. Upon activation of the pumping device 7, the valve closes and brings about the forward movement of toothpaste through tube 14 and the channel 6 to the discharge aperture 4. Upon deactivation of the pumping device the valve opens so that toothpaste can flow out of the supply space 2 into the space below the base 19.

The interior of the handle 1 is constructed in a stepwise cylindrical manner with cylinder sections 9 and 10, the diameter or cross-section of which differs in a graduated manner. Specifically, the cylinder section 10 which is positioned more closely to the pumping device 7 is larger in its cross-section than the cylinder section 9.

A piston 11, slidably disposed within cylinder section 9, has a cylinder-like sealing lip 12 in contact with the internal wall of the cylinder section 9. Furthermore, an internal cylindrical sealing lip 13 is additionally provided by means of which the piston 11 tightly encloses tube 14 which connects the pumping devive 7 with the support handle 3 and the interior of which is a continuation of the channel or conduit 6.

An annular piston 15 is provided in the cylinder section 10 of larger diameter, which piston has a circular sealing lip 16 bearing against the wall of the cylinder section 10. This piston takes the shape of a ring extending between the annular space between cylinders 9 and 10. A cylindrical ring surface 17 of the same internal diameter as the cylinder section 9 is positioned to tightly accommodate the piston 11. An inwardly projecting flange or catch 18 is engaged by piston 11 as it moves toward pump 7, whereby piston 11 and annular piston 15 move as a unit in expelling toothpaste from supply space 2.

A base 19 at the end of the supply space 2 has a contour or profile complementary to the oriented surface of pistons 11 and 15 so that when the pistons are positioned at the bottom of the supply space, no dead space is present between the pistons 11 and 15 and the base 19 so that all the toothpaste can be emptied.

In using the filling toothbrush of the invention, the pumping device 7 is activated by pressing down the diaphragm 8. Toothpaste located in the supply space is forced through tube 14 and channel 6 to the discharge aperture 4 and thereby to the bristles 5. When the diaphragm is released to its deactivated or normal position, the negative pressure arising in the supply space 2 causes atmospheric pressure to act on the outside of the piston 11 so that the piston moves in the direction of the pumping device 7 a distance corresponding to the amount of toothpaste moved forward. This action continues during the further activation of the pumping device until the piston 11 has tightly entered into the mounting accommodation formed by the ring surface 17 and the catch or flange 18. The piston 11 then carries along the piston 15 and the two together close off the cross-section of the cylinder section 10 until it has been emptied.

What is claimed is:

1. In a filling toothbrush having a hollow handle providing space for a supply of toothpaste, said hollow handle terminating in a support with bristles, a discharge aperture in the area of the bristles, a tube within the handle connecting the inner end of said supply space to said aperture, a pump disposed within said handle at said inner end, a check valve between said supply space and said tube which closes upon activation of said pump and causes toothpaste to flow through said tube to said aperture, and opens upon deactivation of said pump to permit toothpaste to flow from said supply space to said pump, the improvement in which said supply space comprises a first cylinder within said handle surrounding said tube, a first annular piston within said first cylinder which slides on said tube, a second cylinder of larger diameter than said first cylinder adjoining said first cylinder.

a second piston for said second cylinder in the form of a ring disposed between the outer diameter of said first cylinder and the inner diameter of said second cylinder, and an inwardly projecting flange on said second ring piston against which said first piston abuts as it moves toward said second cylinder, said first and second cylinders moving in unison to expel toothpaste from said second cylinder.

2. The filling toothbrush of claim 1 in which said first and second pistons have cylindrical sealing lips to provide a tight sliding fit within their respective cylinders.

3. The filling toothbrush of claim 1 in which said supply space has a base at the inner end of the handle spaced from said pump, said base having a contour which complements the contour of said pistons.

4. In a filling toothbrush having a hollow handle comprising at one end a supply space for toothpaste, said handle terminating at the other end in a support for bristles, a discharge aperture opening to said bristles, a conduit between said one end said aperture, pumps means adjacent to said conduit at said one end for forcing toothpaste from said supply space into said conduit, the improvement in which said supply space comprises a first cylinder within said handle surrounding said conduit, a first annular piston within said first cylinder which slides on said conduit, a second cylinder of larger diameter than said first cylinder disposed between the end of said first cylinder and said one end, a second piston for said second cylinder in the form of a ring disposed between the outer diameter of said first cylinder and the inner diameter of said second cylinder, and an inwardly projecting flange on said second piston ring against which said first piston abuts as it moves toward said second cylinder, whereby said first and second cylinders move in unison to expel toothpaste from said second cylinder.

* * * * *